US005498321A

United States Patent [19]

Arnold et al.

[11] Patent Number: 5,498,321

[45] Date of Patent: Mar. 12, 1996

[54] ELECTROLYSIS CELL DIAPHRAGM RECLAMATION

[75] Inventors: Mark L. Arnold, Chagrin Falls; James R. Brannan, Perry; Richard A. Kus; Richard L. Romine, both of Concord, all of Ohio

[73] Assignee: Oxytech Systems, Inc., Chardon, Ohio

[21] Appl. No.: 281,723

[22] Filed: Jul. 28, 1994

[51] Int. Cl.[6] ..... C25B 15/00; C25B 11/20; C23G 1/02; B08B 3/00

[52] U.S. Cl. ..... 205/525; 204/282; 134/3; 134/28; 134/42

[58] Field of Search ..... 204/98, 128, 282, 204/280, 290 R, 283; 210/407, 409; 134/3, 28, 42

[56] References Cited

U.S. PATENT DOCUMENTS

| | | | |
|---|---|---|---|
| 4,252,878 | 2/1981 | Lazarz et al. | 429/250 |
| 4,367,147 | 1/1983 | Asami et al. | 210/636 |
| 4,381,230 | 4/1983 | Burney, Jr. et al. | 204/98 |
| 4,410,411 | 10/1983 | Fenn et al. | 204/283 |
| 4,526,904 | 7/1985 | Kishida et al. | 521/26 |
| 4,606,805 | 8/1986 | Bon | 204/296 |
| 4,853,101 | 8/1989 | Hruska et al. | 204/296 |
| 5,094,895 | 3/1992 | Branca et al. | 428/36.91 |
| 5,133,843 | 7/1992 | Eisman | 204/105 R |
| 5,183,545 | 2/1993 | Branca et al. | 204/252 |
| 5,188,712 | 2/1993 | Dilmore et al. | 204/98 |
| 5,205,911 | 4/1993 | Kawolics et al. | 204/98 |
| 5,246,559 | 9/1993 | Bishara et al. | 204/232 |

*Primary Examiner*—Kathryn Gorgos
*Attorney, Agent, or Firm*—John J. Freer; David J. Skrabec

[57] ABSTRACT

There is now disclosed a method of restoring a used article utilized in electrolysis, such as in a chlor-alkali cell. The used article is usually the cell diaphragm, but may be a cell electrode, particularly when it is in assembly with the cell diaphragm. The restoration method involves treating the article, typically in place in the cell, but which may be removed from the cell, by soaking in a treating composition containing most always hydrochloric acid and corrosion inhibitor. The article after treatment may be baked at elevated temperature. When baking is utilized, it can come before soaking. With or without baking, the article may or may not be involved in a wetting step. Where the restoration involves an article utilized in a chlor-alkali cell, the restoration can readily reduce the problem of hydrogen in the chlorine product produced. Such treatment can also lead to reduced cell voltage as well as reduced cell anolyte level.

34 Claims, No Drawings

ELECTROLYSIS CELL DIAPHRAGM RECLAMATION

BACKGROUND OF THE INVENTION

Electrolytic cells, such as for the electrolysis of aqueous alkali metal chloride solutions, will contain a cathode. There will also be present a separator, such as an asbestos diaphragm or synthetic microporous separator. The separator may be present right on the surface of the cathode, thereby forming a unified assembly of cathode plus separator. It has been known to acidize these cells, e.g., when they are chlor-alkali cells, for cleaning. Caution is always needed, however, to avoid acid attack of the cathode, as well as to avoid degradation of the separator. Thus, where cleaning of the cathode by acidizing would utilize acid having a pH of 1.5 to 2, such was conducted with a cathode protection current applied to the cathode to protect against deleterious pitting. When acidized brine was used in diaphragm cleaning, it was known to employ very dilute acid to avoid attacking the diaphragm. A corrosion inhibitor in low concentration could be utilized. However, in any such cleaning operation, it was often found that a deleterious hydrogen generation problem was encountered after cell start-up.

A recent modification for many such cells is a change in the diaphragm to a generally non-asbestos synthetic fiber separator containing inorganic particulates in a polymeric fiber such as of polytetrafluoroethylene, the separator being more particularly disclosed in U.S. Pat. No. 4,853,101. This combination can provide an improved technology whereby electrolytic cells are maintained in operation for long periods of time. Such extended operation for the cells may create the problem of enhancing the introduction of impurities. As cell operations become more extended, it becomes more challenging to provide consistent, high quality product for the life of the cell as well as extended life for all cell components.

The material of the cathode, at least as a substrate, can be a metal of iron or steel or the like. Electrolytic cells for the electrolysis of aqueous alkali metal chloride solutions employing such cathodes and the above described newer diaphragms, have been found to become susceptible during long cell life to generation of hydrogen gas as an impurity in the chlorine product. This has been attributed to the formation of contaminants such as magnetite on the cathode, which can then become contaminants in the diaphragm. This has been discussed in U.S. Pat. No. 5,205,911. The patent goes on to describe attacking this problem by heating the cathode for a time and temperature sufficient to change the characteristic of any oxygen-containing constituent, e.g., magnetite, which may be present at the surface of the cathode. Although such methodology can be useful, it may not always lend itself to efficient rejuvenation of cell components at the cell room.

Electrolytic alkali metal halide cells, may have cathodes in assembly with ion exchange membranes. It has been observed that the ion exchange groups of these membranes can become contaminated with metals, such as metals of the electrode coatings. This is thus a problem of contamination by the metals themselves. It is further ostensibly a problem associated with the ion exchange groups where an ion exchange membrane is used in the electrolytic cell. This problem, as discussed for example in U.S. Pat. No. 5,133,843, can be addressed, and the membrane rejuvenated, by treatment of the membrane with strong acid at elevated temperature. The metals removed from the ion exchange membrane may then be recovered. Although this operation may be useful for metal recovery, it may be necessary to separate the membrane from the cathode in such technique so as to prevent damage to a sensitive electrode or electrode coating from the concentrated acid, high temperature conditions. Moreover, the technique is only known to be useful for removing metals from the ion exchange membrane.

It would, therefore, be desirable to have a process where the integrity of the cathode assembly could be maintained, if desired, i.e., without disassembly, and that could be utilized to deploy against metal-containing compounds, that is, not against the metals themselves but against compounds which they might form in the cell, which compounds may be both on the electrode as well as on the diaphragm.

SUMMARY OF THE INVENTION

The invention describes a method for providing a successful and desirable reclamation operation, e.g., for diaphragm coated cathode assemblies. This is a reclamation operation which can be readily accomplished, on site at cell rooms, with equipment typically generally at hand. The invention is particularly directed to extended life metal cathodes wherein a diaphragm, especially an asbestos-substitute, synthetic diaphragm, is present directly on the face of the cathode. Following reclamation, the diaphragm can exhibit enhanced freedom from plugging as well as a reduced impurity content. In subsequent cell operation, this can provide for a desirably reduced anolyte level.

In one aspect, the invention is directed to the method of restoring a used article of an electrochemical cell, such an article being selected from the group consisting of an electrode, a diaphragm, or their combination as an assembly, which method comprises:

(A) removing from service such article;

(B) soaking the article for a time of at least about 5 minutes in a liquid soaking medium containing at least about 0.1 weight percent of HCl plus at least about 0.1 volume percent of corrosion inhibitor;

(C) wetting the article, when such an article is a diaphragm or the assembly, in a liquid medium containing wetting agent; and (D) returning the article to service in the electrochemical cell.

In another aspect of the invention, before or after the above-noted step (B), this invention aspect pertains to baking the assembly for a time greater than about 30 minutes at a temperature in excess of 500° F. Art additional aspect pertains to having the above-noted step (C) wetting as an optional step, whereby returning the article to service can follow soaking.

In yet a further aspect, the invention is directed to a liquid composition for restoring a used article of an electrochemical cell, such an article being selected from the group consisting of an electrode, a diaphragm, or their combination in assembly, which composition comprises a liquid medium containing from about 0.1 to about 20 weight percent of hydrochloric acid plus from about 0.1 to about 4 volume percent of corrosion inhibitor.

In a still further aspect, the invention is directed to the method of restoring a used article of an electrochemical cell; the article being selected from the group consisting of an electrode, a diaphragm, or an assembly of electrode-plus-diaphragm, where the method comprises:

(A) removing from service the article;

(B) soaking the article for a time of at least about 5 minutes in an acidic liquid soaking medium having a pH of about 1.5 or less and containing at least about 0.1 volume percent of corrosion inhibitor;

(C) wetting the article, when such article is a diaphragm or is the aforesaid assembly, in a liquid medium containing wetting agent; and (D) returning the article to service in the electrochemical cell.

In yet another aspect, the invention is directed to the method of preparing a soaking solution adapted for restoring a used article selected from the group consisting of an electrode, or diaphragm, and an assembly of the two, which used article is of a chlor-alkali cell, which method comprises admixing corrosion inhibitor with aqueous liquid in an amount sufficient to provide at least about 0.1 volume percent of the corrosion inhibitor to the aqueous liquid and thereafter blending HCl with the resulting admixture in an amount sufficient to provide at least about 0.1 weight percent of such HCl to the aqueous liquid.

Although reclamation is discussed hereinabove, and generally hereinafter, in regard to a diaphragm coated cathode assembly, it is to be understood that the invention is also contemplated to be useful for reclaiming just the diaphragm itself, or just the cathode itself, especially where such would be readily separable rather than in an assembly. Hence, it is to be understood that the discussions herein to the diaphragm and cathode assembly are for illustrative purposes. For example, in some cell apparatus, the diaphragm may be positioned separately from any electrode and yet be in eventual need of restoration. Reference can be made to U.S. Pat. No. 5,246,559, where there is shown the use of a diaphragm, which diaphragm is composed of polytetrafluoroethylene polymer fibers and zirconia inorganic particulates. This diaphragm is fit into a cell where the anode and cathode are spaced apart from the diaphragm and the electrode chambers are separable from each other, thereby providing a readily separable diaphragm. Thus, this diaphragm as a separate item is contemplated for restoration by the present invention. Also, although reference herein is generally made to a cathode, it will be understood by those skilled in the art that in some instances the article restored may simply serve as an electrode in the cell. Thus, when the word "cathode" is used herein, it should not be construed as limiting the invention where it can be more broadly construed.

DESCRIPTION OF THE PREFERRED EMBODIMENTS

Typically, the cathode for the electrolytic cell will be an electroconductive metal cathode, e.g., a ferruginous cathode such as an iron or steel mesh cathode or perforated iron or steel plate cathode. There might be an active surface layer on the cathodet; that is, the cathode might be an "activated" cathode, e.g., an active surface layer of nickel, molybdenum, or an oxide thereof. Other metal-based cathode layers can be provided by alloys such as nickel-molybdenum-vanadium and nickel-molybdenum. Such activated cathodes are well known and fully described in the art. Other metal cathodes can be an intermetallic mixture or alloy form, such as iron-nickel alloy, stainless steel or alloys with cobalt, chromium or molybdenum, or the metal of the cathode may essentially comprise nickel, cobalt, molybdenum, vanadium or manganese. As has been mentioned hereinbefore, in cell operation, the cathode may become contaminated, e.g., with a metal compound such as magnetite forming on the surface of the cathode which is operating in a chlor-alkali cell.

For the diaphragm in the cell, asbestos is a well-known and useful material for making a separator. Additionally, synthetic, electrolyte permeable diaphragms can be utilized. The diaphragm can be deposited directly on the cathode as disclosed for example in U.S. Pat. No. 4,410,411. Such a deposited diaphragm as therein disclosed can be prepared from asbestos plus a halocarbon binding agent. The synthetic diaphragms generally rely on a synthetic polymeric material, such as polyfluoroethylene fiber as disclosed in U.S. Pat. No. 4,606,805 or expanded polytetrafluoroethylene as disclosed in U.S. Pat. No. 5,183,545. Such synthetic diaphragms can contain a water insoluble inorganic particulate, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated hereinby reference.

Although the restoration method has been discussed hereinabove in relation to diaphragms, it is to be understood that such method is contemplated for use with membranes, e.g., reclamation of a membrane coated cathode assembly. This could be reclamation of such an assembly where both the membrane and the cathode are contaminated, generally with a metal-containing compound such as the above-mentioned magnetite contamination. Thus, although the present invention is most particularly directed to reclamation of separators of the diaphragm type, it is also contemplated for use where the cell separator is of the membrane type. Hence, when the word "diaphragm" is used herein, it should not be construed as limiting the invention where it can be more broadly construed.

The invention is most particularly directed to diaphragm coated cathodes and such will usually be referred to hereinafter when discussing the invention. With this in mind, there will now be presented a brief overview of various aspects associated with operation procedures. This is not to be construed as limiting the invention. In this brief overview, the operational procedures are initiated by de-energizing a cell. Then the cell is drained. The diaphragm coated cathode assembly is then treated. Where the cell is a chlor-alkali cell, the cell will be filled with brine and then energized. Various operations will be discussed in greater detail hereinbelow. It is to be understood that variations in operations can be utilized. For example, after de-energizing and draining, the diaphragm coated cathode may be retained in the cell for treatment. It may also be removed from the cell for treatment. Such removal may include, particularly where separating can be done with ease, separation of the diaphragm from the cathode. Thus, only the diaphragm may be removed from the cell in disassembly for some cells.

Usually, the diaphragm coated cathode, i.e., the cathode "assembly" or cathode "unit" as the terms are used herein, can undergo routine maintenance during cell shutdown. As noted hereinbefore, this may or may not require removal of the cathode assembly from the cell. This will, however, be "removing of the assembly from service". Thus, removal of the assembly from service may or may not include removal from the cell. It is most always the case that the cathode assembly will be maintained in the cell for restoration in accordance with the present invention where the separator is a diaphragm and the cell is for electrolysis of alkali metal chloride solutions.

The next step, whether the cathode assembly is removed from the cell or maintained in the cell in the circuit, will generally be a soaking step. It is, however, to be understood that this step may be a baking step. Baking, as it is utilized herein and which can be an optional step, even though it precedes soaking, will nevertheless be discussed hereinbelow following the description of soaking.

Soaking for economy takes place in a liquid soaking medium. The liquid medium for economy is an aqueous medium and may be serviceably contributed by the process water which can be available at the plant site of the cell operation. The soaking will be conducted in a manner sufficient to submerge, or at least substantially immerse, the total unit so that at least virtually all, and preferably completely all, of the unit is contacted by the soak composition during the soaking period. The soaking will continue for a time of as quickly as about 5 to 20 minutes, and will typically not be extended beyond about 72 hours. A soaking of less than about 5 minutes can be insufficient to provide desirably enhanced restoration of the unit, while soaking for more than about 72 hours is uneconomical. Preferably for best economy as well as enhanced rejuvenation, the unit will be soaked for a time of from about 30 minutes to about 2 hours. During the soaking, it is advantageous to agitate the soaking composition. This will assist in ensuring that the soaking composition will contact the entire unit with soaking liquid. Agitation can be by any of the means suitable for providing agitation of a liquid. Usually, this agitation will be accomplished by circulation, e.g., by pumping the soaking liquid from the anode space to the hydrogen outlet, or from the hydrogen outlet to the anode space, or the soaking liquid could be circulated within the anode space. Where the elements to be soaked are retained in the cell and such cell is used for chlor-alkali production, the recirculation may be, for some cells, from the anode compartment through the diaphragm to the cathode compartment and out the perc (percolator) pipe to return to the anode compartment. To maintain a steady flow of soaking liquid through the diaphragm, usually, the liquid will be circulated at the rate of about 1 volume percent or less of the liquid per minute. For example, a soaking liquid bath of on the order of 250 to 350 gallons may be suitably recirculated at a rate within the range of from about 1 gallon per minute (gal/min.) to about 6 gals/min.

The liquid soaking medium in addition to being an aqueous medium for economy, will contain from about 0.1 weight percent up to about 20 weight percent of HCl. Use of less than about 0.1 weight percent of HCl can be inefficient for obtaining an enhanced unit restoration even for extended soak times of on the order of about 72 hours. On the other hand, use of greater than about 20 weight percent of HCl may be deleterious by leading to potential acid fuming as well as possible corrosion. In addition to the deleterious corrosion potential, the acid concentration may be dictated by any sensitive cell elements that might come into contact with the acid, especially where soaking will proceed with the cell maintained in the circuit, e.g., when the cathode assembly is not removed from the cell for soaking. In some instances, for example, an electrode coating may be attacked by a concentration of HCl of greater than about 5 to 10 weight percent. Advantageously, for most efficient rejuvenation, the soak solution will contain at least about 3 weight percent of HCl, and preferably at least about 10 weight percent of HCl, up to about 15 weight percent of HCl. It will be understood that the shorter soak times will most always be coordinated with the more concentrated acid conditions. For example, HCl concentrations of 15–20 weight percent are the concentrations of choice for 5 to 20 minute soak times. Lesser acid concentrations are then usually combined with longer soak times. Although it is contemplated that HCl should be present in the soak liquid, other acids may be useful. Usually, for efficiency and economy only HCl will be used. Other acids, utilized alone or in mixture, which are contemplated as being useful, when they are inorganic can include nitric, sulfuric and phosphoric acids, and when they are organic can include oxalic acid. The most serviceable aqueous soaking compositions will have a pH of about 1.5 or less.

The soaking liquid will also contain a corrosion inhibitor. Preferably, the inhibitor is Activol available from the Harry Miller Corporation. This formulation is a brown liquid known to contain 30–40 percent of ethyl octynol. Usually, the corrosion inhibitor will be utilized in an amount of at least about 0.1 volume percent. Advantageously, no more than about 2 volume percent of Activol will be used, although for other corrosion inhibitors they may be typically utilized in an amount of about 3–4 volume percent. Use of less than about 0.1 volume percent of inhibitor can be insufficient for providing threshold corrosion protection, while on the other hand, use of greater than about 2 volume percent of Activol inhibitor can be uneconomical by adding to the cost of the soaking liquid without commensurate enhancement in activity. Preferably, for best economy coupled with desirable soaking liquid activity, the liquid will contain from about 0.5 to about 2 volume percent of corrosion inhibitor.

Suitable corrosion inhibitors include the hydrochloric acid corrosion inhibitors. These include Rodine 213 and 214 marketed by the Parker-Amchem Division of the Henkel Corporation and known to contain isopropanol as well as propargyl alcohol together with complex substituted ketoamine. Rodine 213 is known to be an organic, liquid, cationic corrosion inhibitor for inhibiting the attack of hydrochloric acid on iron and steel. Another useful corrosion inhibitor is the Plus stabilizer of S.T.I. International, Inc. which contains phosphoric acid, oxalic acid, complex amines and foaming/wetting intensifier additives. The material is totally miscible with water. Generally, the corrosion inhibitor used whether in solid or liquid foam will be discussed herein as soluble in the liquid soaking medium, but it is to be understood that within the useful concentration range for the inhibitor, so long as it is soluble or miscible without creating a separate liquid layer, it will be suitable for use. In the concentration ranges used, this material may not be completely soluble in water but it can be sufficiently mixed with water so as to be suitable for use.

In preparing the liquid soaking medium, it is advantageous to prepare the soaking composition by adding the HCl to water, possibly with agitation. For most efficient blending, it is preferred to add the Activol to the water before the HCl solution. The Activol addition may be accompanied with agitation. Usually, the temperature of the soaking liquid will be simply the temperature of the process water available at the plant site. Thus, it is contemplated that the liquid temperature may vary within the range from about 40° F. to about 90° F. Usually, it is not contemplated to heat the soaking liquid, but heating could be utilized. In addition to the HCl corrosion inhibitor and wetting agent, other substituents which may be present in the soaking liquid include defoaming agents. However, it is expected that the total amount of such additional substituents will be no more than about 2 weight percent, and generally less, e.g., on the order of about 0.1 weight percent or less, of the soaking liquid.

After the assembly has been soaked, it can be removed from the soaking solution and flushed with water. Flushing will remove acid and inhibitor. This can be flushing such as with tap water, D.I. (deionized) water or process water, i.e., water which has been treated but is not considered to be suitable for drinking water. The assembly may also be flushed with other liquids, typically other suitable cell room liquids, such as brine, e.g., neutral to basic brine. The flushing is usually continued until the pH of the flushing liquid reaches 6 or higher. As with the soaking liquid, the flushing liquid will be useful at the temperature at which the liquid is available, i.e., a moderate temperature such as process liquid at a temperature within the range from about 40° F. to about 90° F.

After flushing, it can also be serviceable to bake the assembly, which in addition to volatilizing any liquid contained in either a cathode or the diaphragm and thus completely drying the assembly, can additionally change the characteristic of oxygen-containing constituents that may be present on the cathode. For example, baking may provide for the oxidation of electrically conductive iron oxides to non-conductive ferric oxide, e.g., convert any surface magnetite on the cathode to hematite, as taught in U.S. Pat. No. 5,205,911, the disclosure of which is incorporated herein by reference. However, as will be understood by those skilled in the art, baking may deleteriously affect some electrode coatings, most notably anode coatings. Thus, baking may not be undertaken with these articles.

When the baking step is undertaken, it will generally be carried out for a time of at least about 30 minutes. It may be carried out as long as about 32 hours. Typically, baking for less than about 30 minutes will be insufficient to change the characteristic of oxygen-containing constituents. Baking for greater than about 32 hours can be uneconomical. Preferably, for efficiency and economy, the baking will be carried out for a time of about 2 to about 24 hours. Baking can be carried out by any suitable means for achieving an elevated temperature for a metal-containing assembly. Such means can include an oven, e.g., a forced air or convection oven. Regardless of the heating means, the temperature of the heating will be the temperature attained by the assembly. This will advantageously be a temperature in excess of about 500° F. Generally, when the attained temperature is less than about 500° F., it will be insufficient for oxygen-containing constituent conversion. Most always, the heating temperature will not exceed about 600° F. A baking temperature in excess of about 600° F. may lead to degradation, e.g., charring, of the diaphragm. Following baking, the assembly is usually permitted to air cool to room temperature although accelerated cooling as by contact with plant process water, may be utilized.

Whether or not the assembly is baked, it may be wetted before reassembly into the restored electrochemical cell. If it is not wetted, it can proceed to go back into service. For example, in a chlor-alkali cell, the cell can be filled with brine and then energized. When wetting is utilized, the wetting will be with a solution containing a wetting agent, e.g., a surfactant. Although the word "solution" is used herein with regard to wetting, it is to be understood that the liquid used may be merely miscible liquids or a dispersion, which liquids are not present in more than one readily apparent visible phase. Advantageously, for efficient wetting, the solution will contain a fluorosurfactant. These are such agents that have been disclosed in U.S. Pat. No. 4,252,878, the disclosure of which is incorporated herein by reference. Representative of these fluorosurfactant agents are those available from DuPont under the Zonyl trademark. Such materials include Zonyl FSB, an amphoteric fluorosurfactant which is a fluoroalkyl substituted betaine, Zonyl FSC and Zonyl FSP. In addition to utilizing an amphoteric surfactant, it is also contemplated to use anionic, cationic or nonionic surfactants. The particularly preferred fluorosurfactant for efficient wetting is Zonyl FSN non-ionic fluorosurfactant, which is understood to be a perfluorinated polylower alkylene oxide glycol based ether. In general, the surfactant provides a hydrophilic film on the surface of the diaphragm and, upon drying of the diaphragm, provide the diaphragm with enhanced wettability.

Where the diaphragm wetting step is employed, the assembly will be wetted in a solution containing at least about 1 volume percent of the wetting agent, e.g., a surfactant. Generally, there will not be present more than about 10 volume percent of the agent. Use of less than about 1 volume percent of agent may provide an insufficient concentration for complete surface wetting of the diaphragm. On the other hand, utilizing a solution containing above about 10 volume percent of the agent can be uneconomical. Preferably, the wetting solution will contain from about 2 to about 8 volume percent of agent.

In addition to these hereinabove-discussed agents, suitable wetting agents include alcohols, typically lower molecular weight alcohols such as isopropyl alcohol and butanol. When using such alcohols, it is advantageous for efficient wetting to use butanol, and n-butanol is preferred. For the alcohols, these will typically be provided in solution in a concentration similar to the fluorosurfactants. Additional suitable surfactants include non-ionic surfactants, e.g., the Triton surfactants such as Triton X-100 of Union Carbide Corporation. Triton is a trademark of Rohm and Haas Company and Triton X-100 is a cogeneric mixture of isooctyl phenoxy polyethoxy ethanols.

Where wetting has been utilized, the assembly may be subsequently dried, or this can be dispensed with. When used, drying will volatilize the moisture retained from the wetting step. In drying, the time of employed can be just a few hours, usually at least about 2–4 hours, which time generally will not be beyond about 24 hours. A drying time of less than about 2 hours can be insufficient to provide completely dried surfaces for both the cathode and diaphragm. A drying time of greater than about 24 hours can be uneconomical. Preferably, for best economy as well as efficient drying, the assembly will be dried for a time from about 4 to about 16 hours. The drying will be carried out at a temperature in excess of about 120° F. Drying at a lower temperature can be inefficient for providing complete assembly drying in an economical time. On the other hand, drying at a temperature of greater than about 190° F. will not be employed because it can lead to deactivation of the surfactant. Preferably, the drying will be at a temperature within the range of from about 140° F. to about 180° F. As with the baking described hereinbefore, the drying temperature is the temperature achieved by the assembly during drying. Also, it can be achieved by any means suitable for drying a metal-containing assembly. Such means include convection oven drying with a preferred mode of drying being a forced air oven.

When the used article is in restored form, e.g., after the above-mentioned flushing step (which follows the soaking) and which may be followed by either or both of the baking and wetting steps, and possibly by reassembly into the cell where needed, the cell can then be restarted. This will be restarting by any of those means well known to those skilled in the art for starting the particular electrochemical cell which has been restored in the manner as described hereinbefore.

The following examples show ways in which the invention has been practiced but should not be construed as limiting the invention.

EXAMPLE 1

In a commercial chlor-alkali plant, a cell was removed from service and disassembled. This included removal of the cathode-plus-diaphragm assembly from the cell. This assembly had a woven wire metal cathode; the metal more particularly being mild carbon steel. The diaphragm of the assembly was a diaphragm as described in U.S. Pat. No. 4,853,101. More particularly, the organic halocarbon polymer fiber of this diaphragm was polytetrofluorethlyne fiber and the finely-divided organic particulates embedded into the polymer fiber were zirconia.

A soak solution was made up of process water containing 10% by weight of hydrochloric acid (a 5 weight percent hydrochloric acid solution contains 14.1 volume percent of 20° Baume' hydrochloric acid). This solution also contained 1% by volume of Activol 7711-B hydrochloric acid corrosion inhibitor (Harry Miller Corporation). Activol 7711-B is a brown liquid, readily soluble in water, having a specific gravity at 25° C. of 1.014 and containing 30–40 weight percent of ethyl octynol.

The assembly was first flushed with process water, then soaked in the solution for three days. The soaking progressed by initially feeding soak solution into the anode compartment of the cathode, then having the solution recirculated by pumping, during the three day soaking. The recirculation rate was 2.5 gal/min, from the anode space to the hydrogen outlet, providing a steady flow of soak solution through the diaphragm.

The assembly was then drained of soak solution and next flushed with process water for four hours to remove soak solution from the diaphragm. The assembly was then transferred to an oven and baked at 560° F. oven air temperature for 18 hours. Upon removal from the oven and cooling to room temperature, the diaphragm of the assembly was then wetted by soaking for 19 hours in an aqueous solution containing 4 volume percent Zonyl FSN. This is a fluorinated surface active agent available from DuPont under the Zonyl trademark. The cell was then returned to the oven and dried at 170° F. oven air temperature for 22 hours.

The electrochemical cell was then reassembled including installation of the restored cathode plus diaphragm assembly. The cell was then restarted, and at restart, while running on full brine feed, operating data, monitored daily, showed a hydrogen content at start-up in the chlorine product of between 0.07 percent to 0.11 percent by volume. After six weeks on line, the cell was producing hydrogen in the chlorine product at less than 0.10 volume percent. This is hydrogen production down from 0.62 volume percent prior to cell shutdown and assembly restoration. This on line operation with no hydrogen readings above 0.10 volume percent was found to continue for months, e.g., at least six months of operation. Moreover, the cell achieved a voltage savings during this time, e.g., about 30 millivolts after 200 days on line.

EXAMPLE 2

A commercial chlor-alkali plant cell was removed from service and disassembled in the manner of Example 1. The assembly had a metal cathode and a diaphragm as described in Example 1. A soak solution was made up of process water containing 15% by weight of hydrochloric acid and 1% by volume of the Example 1 corrosion inhibitor. The assembly was soaked in the solution as described in Example 1, but only for one day. The assembly was then treated in the manner of Example 1, e.g., flushed with process water, baked and wetted with the Zonyl FSN aqueous solution.

The electrochemical cell was then reassembled including installation of the restored cathode plus diaphragm assembly. The cell was then restarted, and after 11 weeks on line the cell was operating with hydrogen at less than 0.10 volume percent in the chlorine product. Moreover, the cell achieved an initial voltage savings of 150 mV (millivolts).

EXAMPLE 3

A commercial chlor-alkali plant cell was removed from service and disassembled in the manner of Example 1. The assembly had a metal cathode and a diaphragm as described in Example 1. A soak solution was made up of process water containing 15% by weight of hydrochloric acid and 1% by volume of the Example 1 corrosion inhibitor. The assembly was soaked in the solution as described in Example 1, but only for one day.

The assembly was then initially treated in the manner of Example 1, e.g., it was flushed with process water, but subsequently it was not baked. Thus, the flushing with process water was followed by wetting of the diaphragm with the Zonyl FSN aqueous solution. During the wetting, recirculation was used, with a circulating pump moving the solution from the anode chamber to the cathode chamber of the cell at 2 gal/min.

The electrochemical cell was then reassembled, including installation of the restored cathode plus diaphragm assembly. The cell was then restarted, and after 4 weeks on line, the cell was operating with hydrogen at less than 0.10 volume percent in the chlorine product.

EXAMPLE 4

A commercial chlor-alkali plant cell was removed from service and disassembled in the manner of Example 1. The assembly had a metal cathode and a diaphragm as described in Example 1. A soak solution was made up of process water containing 10% by weight of hydrochloric acid and 1% by volume of the Example 1 corrosion inhibitor. The assembly was soaked in the solution as described in Example 1, but only for 14 hours.

The electrochemical cell was then reassembled, i.e., there was no baking or wetting with Zonyl solution. The cell was then restarted, and after 3 weeks on line the cell was operating with hydrogen at less than 0.10 volume percent in the chlorine product. This is hydrogen production down from 0.64 volume percent prior to cell shutdown and assembly restoration. Moreover, the cell achieved a voltage savings, e.g., 20 mV at 60 days on line.

We claim:

1. The method of restoring a used cathode-plus-diaphragm assembly of a chlor-alkali cell, which assembly contains a cathode coated with a synthetic diaphragm separator and which restoration provides for reduced hydrogen in chlorine gas evolved by the cell, which method comprises:

(A) removing from service the cathode-plus-diaphragm assembly without separating the cathode from the diaphragm;

(B) soaking said assembly for a time within the range of from about 5 minutes to about 72 hours in a liquid soaking medium containing from at least about 3 weight percent of HCl plus at least about 0.1 volume percent of corrosion inhibitor, by:

(i) immersing said assembly in said liquid soaking medium, and (ii) flowing said liquid soaking medium through said diaphragm;

(C) separating said assembly from said solution and flushing the assembly with aqueous medium;

(D) baking the assembly for a time greater than about 20 minutes at a temperature in excess of about 500° F.;

(E) wetting the diaphragm of said assembly with wetting agent; and (F) drying said assembly at a temperature not in excess of about 190° F.; with the proviso that the baking step (D) may precede the soaking step (B).

2. The method of claim 1, wherein there is restored an assembly having a metal cathode which is one or more of an activated metal cathode or a mild carbon steel cathode.

3. The method of claim 1, wherein there is removed from service an assembly having an electrolyte permeable, synthetic diaphragm.

4. The method of claim 3, wherein said diaphragm is of non-isotropic organic and inorganic composite fibers comprising organic halocarbon polymer fiber in adherent combination with finely-divided inorganic particulates impacted into said fiber during fiber formation.

5. The method of claim 1, wherein said soaking after removing said assembly from service is in an aqueous liquid soaking solution of said HCl plus corrosion inhibitor.

6. The method of claim 1, wherein said soaking after removing said assembly from service is in said liquid soaking medium for a time of at least about 20 minutes, with the medium containing up to about 20 weight percent HCl, while also containing not in excess of about 4 volume percent of corrosion inhibitor.

7. The method of claim 1, wherein said soaking after removing said assembly from service is in said liquid soaking medium for a time from about 30 minutes to about 2 hours, with the medium containing from about 0.5 to about 2 volume percent of corrosion inhibitor.

8. The method of claim 1, wherein said soaking after removing said assembly from service includes recirculating said medium during soaking.

9. The method of claim 8, wherein said liquid soaking medium is recirculated at a rate within the range of from about one to about six gallons per minute.

10. The method of claim 1, wherein said soaking after removing said assembly from service is in said liquid soaking medium having a pH of less than about 1.5 which medium is maintained at a moderate temperature within the range of from about 40° F. to about 90° F.

11. The method of claim 1, wherein said assembly is flushed after soaking with an aqueous liquid of one or more of deionized water, tap water, brine or process water.

12. The method of claim 1, wherein said assembly is flushed with aqueous liquid until the aqueous liquid pH reaches about 6, which aqueous liquid is maintained at a moderate temperature within the range of from about 40° F. to about 90° F.

13. The method of claim 1, wherein said assembly is baked after flushing for a time up to about 32 hours and is wetted after baking in a liquid wetting medium containing up to about 10 volume percent of said surfactant.

14. The method of claim 1, wherein said assembly is baked after flushing at a time of from about 2 to about 24 hours at a temperature within the range of from about 500° F. to about 600° F.

15. The method of claim 1, wherein said baking converts electrically conductive iron oxides on the cathode to non-conductive ferric oxide.

16. The method of claim 1, wherein said wetting after baking is in a liquid wetting medium containing one or more of anionic, cationic, nonionic or amphoteric surfactant, or low molecular weight alcohol.

17. The method of claim 16, wherein said wetting after baking is with a surfactant that is one or more of isopropyl alcohol, butyl alcohol or fluorosurfactant.

18. The method of claim 1, wherein said drying of said assembly is for a time within the range from about 2 hours to about 24 hours at a temperature in the range from about 120° F. to about 190° F.

19. A restored cathode-plus-diaphragm assembly prepared by the method of claim 1.

20. The method of restoring a used cathode-plus-diaphragm assembly of a chlor-alkali cell, which assembly contains a cathode coated with a synthetic diaphragm separator and which restoration provides for reduced hydrogen in chlorine gas evolved by the cell, which method comprises:

(A) removing from service said cathode-plus-diaphragm assembly without separating the cathode from the diaphragm;

(B) soaking said assembly for a time of at least about 5 minutes in a liquid soaking medium containing at least about 3 weight percent of HCl plus at least about 0.1 volume percent of corrosion inhibitor, by:

(i) immersing said assembly in said liquid soaking medium, and (ii) flowing said liquid soaking medium through said diaphragm;

(C) separating said assembly from said solution and flushing the assembly with aqueous medium; and (D) returning said assembly to service in said electrochemical cell.

21. The method of claim 20, wherein there is removed from service an assembly of an electrolyte permeable, synthetic diaphragm.

22. The method of claim 21, wherein there is removed from service an assembly of a diaphragm of non-isotropic organic and inorganic composite fibers comprising organic halocarbon polymer fiber in adherent combination with finely-divided inorganic particulates impacted into said fiber during fiber formation.

23. The method of claim 20, wherein there is removed from service an assembly of an electroconductive metal cathode.

24. The method of claim 23, wherein said cathode is a ferruginous metal cathode.

25. The method of claim 20, wherein said soaking after removing said assembly from service is in an aqueous solution of said HCl plus corrosion inhibitor.

26. The method of claim 20, wherein said soaking after removing said assembly from service is in said liquid soaking medium for a time within the range of from about 20 minutes up to about 72 hours, in medium containing up to about 20 weight percent of HCl, while containing not in excess of about 4 volume percent of corrosion inhibitor.

27. The method of claim 20, wherein said soaking after removing said assembly from service is in said liquid soaking medium for a time from about 30 minutes to about 2 hours, with the medium containing from about 0.5 to about 2 volume percent of corrosion inhibitor.

28. The method of claim 20, wherein said flowing of liquid soaking medium through said diaphragm includes recirculating said medium during soaking.

29. The method of claim 28, wherein said liquid soaking medium is recirculated at a rate within the range of from about one to about six gallons per minute.

30. The method of claim 20, wherein said soaking after removing said assembly from service is in said liquid soaking medium having a pH of less than about 1.5 which medium is maintained at a moderate temperature within the range of from about 40° F. to about 90° F.

31. The method of claim 20, wherein said assembly after soaking is flushed after soaking with an aqueous liquid of one or more of deionized water, tap water, brine or process water.

32. The method of claim 31, wherein said assembly is flushed with aqueous liquid until the aqueous liquid pH reaches about 6, which aqueous liquid is maintained at a moderate temperature within the range of from about 40° F. to about 90° F.

33. The method of claim 20, wherein said assembly after flushing is dried for a time up to about 24 hours at a temperature not in excess of about 190° F.

34. A restored assembly of electrode-plus-diaphragm prepared by the method of claim 20.

* * * * *